United States Patent [19]

Gillette

[11] 4,209,951

[45] Jul. 1, 1980

[54] PISTON RING HONING

[75] Inventor: Robert H. Gillette, Angola, Ind.

[73] Assignee: Brammall, Inc., Angola, Ind.

[21] Appl. No.: 888,340

[22] Filed: Mar. 20, 1978

Related U.S. Application Data

[60] Division of Ser. No. 880,810, Feb. 24, 1978, which is a continuation of Ser. No. 741,501, Nov. 12, 1976, abandoned.

[51] Int. Cl.[2] ..... B24B 1/00

[52] U.S. Cl. ..... 51/290; 51/67

[58] Field of Search ..... 51/290, 154, 161, 103 WH, 51/48, 67

[56] References Cited

U.S. PATENT DOCUMENTS

| | | | |
|---|---|---|---|
| 1,859,595 | 5/1932 | Mills | 51/67 |
| 1,878,116 | 9/1932 | Deutch | 51/48 R |
| 2,257,452 | 9/1941 | Binns | 51/67 |
| 2,654,977 | 10/1953 | Squibb | 51/103 WH |
| 2,691,253 | 10/1954 | Billeter | 51/67 |
| 2,749,672 | 6/1956 | Haldeman | 51/103 WH |
| 2,771,662 | 11/1956 | Ziska | 51/103 R |
| 2,958,985 | 11/1960 | Mahoney | 51/59 |
| 3,481,083 | 12/1969 | David | 51/67 |

*Primary Examiner*—Harold D. Whitehead

*Attorney, Agent, or Firm*—Hill, Van Santen, Steadman, Chiara & Simpson

[57] ABSTRACT

A piston ring honing machine and method are disclosed wherein a stack of piston rings are face finished simultaneously by compressing the rings radially inwardly and into a generally circular configuration and retaining the outside diameter of that circular configuration by confining the compressed rings within a plurality of cylindrical drive rollers disposed about the rings. A honing tool is placed against the ring faces and the rings driven to rotate about the circle center by rotation of one or more of the cylindrical rollers. The stack of rings therefore moves relative to the honing tool to finish the ring face. The tool may be reciprocated in the direction of the cylindrical roller axes to more uniformly finish the ring faces.

2 Claims, 16 Drawing Figures

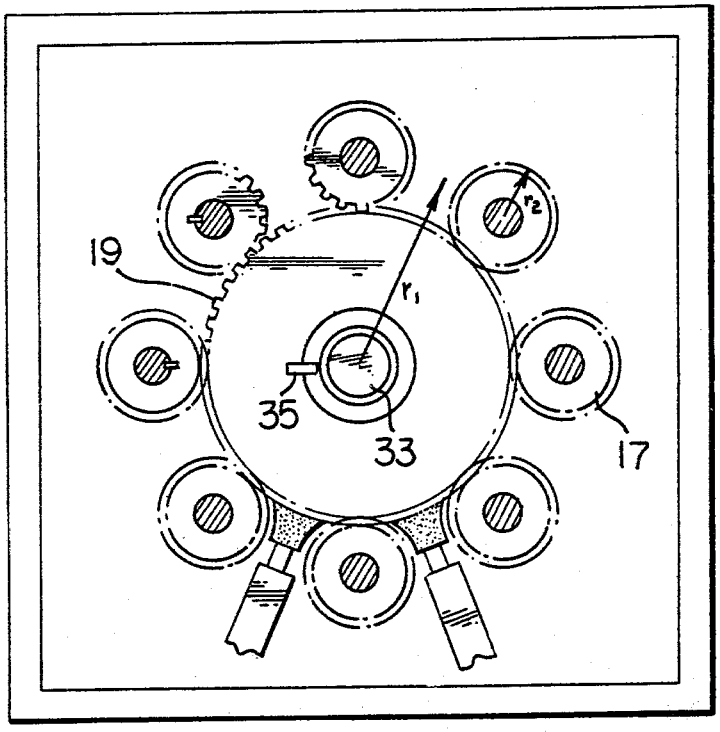
FIG. 3
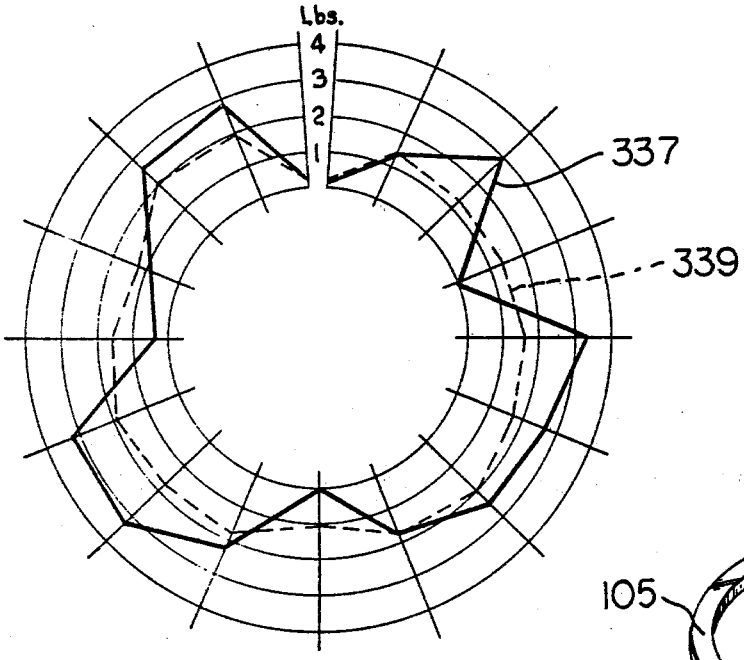
FIG. 15
FIG. 7
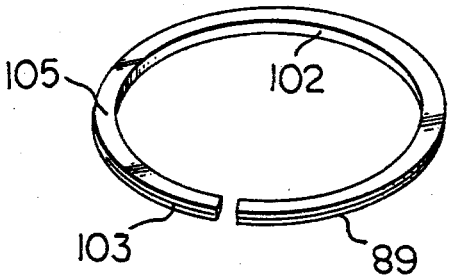

PISTON RING HONING

This is a division, of application Ser. No. 880,810, filed Feb. 24, 1978 which is a continuation application of Ser. No. 741,501, filed Nov. 12, 1976, now abandoned.

BACKGROUND OF THE INVENTION

The present invention relates generally to methods and apparatuses for finishing the surface of a workpiece and, more particularly, the entire outer peripheral surface of a generally cylindrical workpiece. A specific disclosed embodiment in one preferred form relates to the finishing of piston ring faces.

The manufacture of piston rings, for example, of the type found in the ordinary internal combustion engine, is a sophisticated, many step process and briefly would typically include forming, for example, by casting, a hollow shell of ring material and slotting one edge of that shell after which the slotted shell is sliced to form the several C-shaped rings and each ring has its top and bottom (flat) surfaces finished and its face (that portion which typically engages the internal combustion engine cylinder wall) provided with a groove or ducted, depending upon the type of ring to be formed, whereafter that ring face is finished by a lapping process.

The typical ring face lapping process is carried out within a cast iron sleeve in the presence of a diamond abrasive compound requiring typically around 10 minutes to complete and, of course, inducing rather rapid wear in the cast iron sleeve requiring frequent replacement of those sleeves once they have experienced 6 to 8 one thousandths of an inch wear. Cleaning of the rings is also quite difficult after such face finishing and the abrasive medium is relatively expensive.

SUMMARY OF THE INVENTION

The object of the present invention is to provide a method for honing piston rings wherein a plurality of piston rings are stacked and supported so that they have a common center axis and their outer surfaces are engaged with a plurality of rollers mounted parallel to the center axis and wherein at least one of the rollers is driven so as to rotate the piston rings. The outer surfaces of the piston rings, are engaged with a first tool mounted between two of the plurality of rollers and the first tool is moved parallel to the center axis to hone the outer surfaces of the rings and further including engaging the outer surfaces of said piston rings with a second tool on the sides opposite to the sides engaged by the first tool and moving said first tool parallel to said center axis to hone the outer surfaces of the rings.

BRIEF DESCRIPTION OF THE DRAWING

FIG. 3 is a view from the top in section of the portion of the machine of FIG. 1 including the gear drive arrangement for the several rollers;

FIG. 7 is a perspective view of a typical piston ring to be face finished according to the teachings of the present invention;

FIG. 13, show the control relays and operator interface portions of the control circuitry;

FIGS. **14*a* and 14*b* illustrate an alternate structure for supporting and moving the honing stones; and FIG. 15** illustrates the improvement in eccentricity or, equivalently, radial pressure pattern achieved by the present invention.

Throughout the several drawing views like reference numerals identify like elements and the following detailed disclosure is illustrative of the invention in one form and is not to be construed as limiting in any manner.

DESCRIPTION OF THE PREFERRED EMBODIMENT

Figure 1:
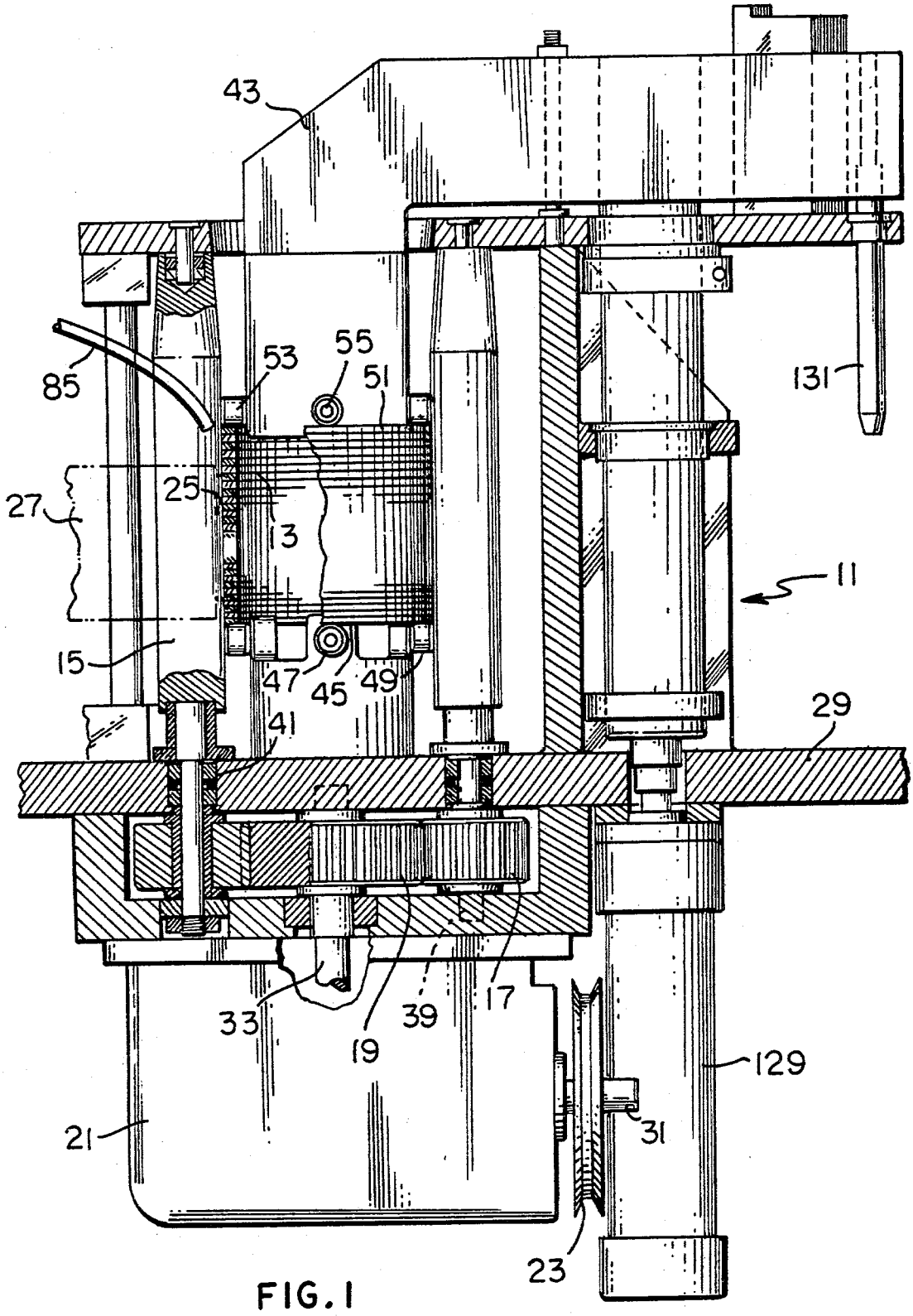
FIG. 1 is a side elevation of a preferred embodiment partially sectioned to reveal the workpiece and salient parts.

Considering first FIG. 1, the machine 11 for finishing the surface of a workpiece 13 includes a plurality of generally parallel, axially extending cylindrical rollers such as 15 each of which is rotatable about its axis and positioned to simultaneously engage the workpiece 13. One or more of the rollers is driven to rotate about its respective axis, for example, by the intermeshed gears 17 and 19 which are coupled by way of a speed reducing gear box 21 and a V-belt pulley 23 to an electric motor. A surface treating tool 25 which may be an abrasive element is supported by a tool holder 27 for movement between an adjacent pair of rollers so that the workpiece and tool are engaged and driving a roller induces movement of the workpiece relative to the tool to finish the workpiece surface.

Figure 2:
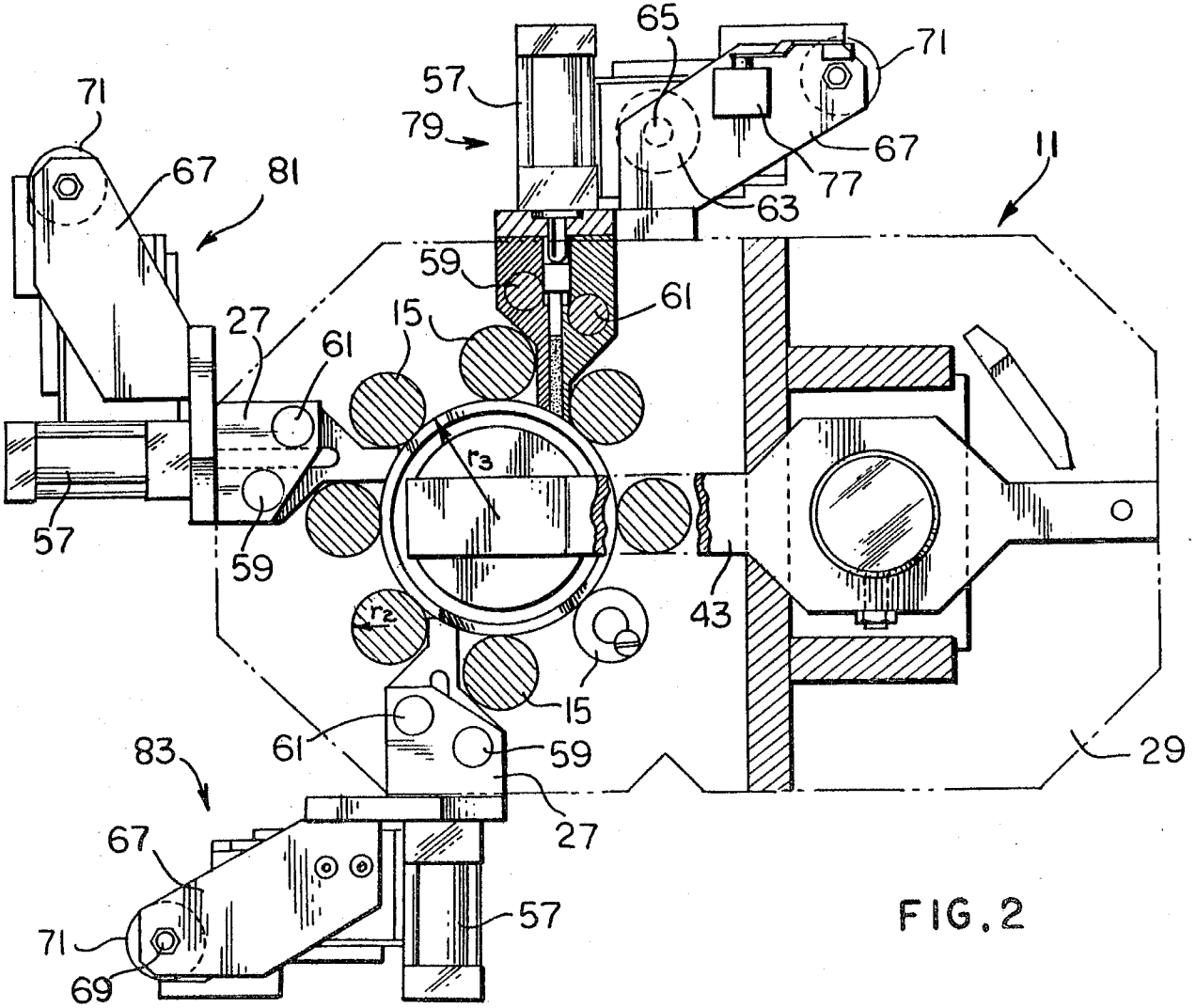
FIG. 2 is a top plan view of the machine of FIG. 1.

Considering in greater detail FIGS. 1, 2 and 3, the machine of the present invention is built about an elevated platform 29 beneath with a motor 30 is disposed. The motor drives a V-belt interconnecting the motor to pulley 23 and rotation of the pulley 23 is transmitted by shaft 31 into the speed reducing gear box 21, the output shaft 33 of which is keyed by key 35 to gear 19. The gear 19 functions as a drive gear and meshes with a series of eight driven gears such as 17. The driven gears are similarly keyed as by key 37 to their corresponding shafts or axles such as 39. The axles 39 are suitably journalled in bearings such as 41 and mechanically coupled to or integral with the cylindrical rollers such as 15. Thus, each of the eight cylindrical rollers rotate about parallel axes which axes are spaced about the periphery of a circle of radius $r_1$ as seen in FIG. 3. Rotation of the gear 19 of course induces rotation in each of the cylindrical rollers in the same sense, e.g. clockwise, as viewed from above, about their respective axes. Of course, different size rollers could be employed spaced different amounts from the center of shaft 33; however, it is convenient to employ rollers of identical radii $r_2$ equally spaced from the center so that a piston ring, when compressed and confined within the rollers, will assume a generally circular configuration of outside radius $r_3$ where $r_3=r_1-r_2$.

The machine is loaded for operation by moving arm 43 out of the way in a manner to be described subsequently, compressing the piston ring radially inward and placing the compressed ring within the cage formed by the eight rollers after which the ring is allowed to spring outwardly so as to engage most or all of the eight rollers. While one piston ring could be so processed, in a preferred form a column of about 50 piston rings were simultaneously face finished in about two minutes illustrating the substantial improvement over the approximately 10 minute prior art lapping process.

The lowermost piston ring 45 comes to rest on a series (typically four) of retaining rollers such as 47 and 49 and the uppermost piston ring 51 is prevented from moving upwardly during processing by a similar group of retaining rollers such as 53 and 55, the latter rollers being supported on the arm 43 which is moved into the position shown in FIG. 1 for processing the piston rings. The stack of piston rings now forms a generally hollow cylindrical shell held within the rollers and rotatable thereby for finishing the entire outer peripheral surface of that shell.

Figure 4:
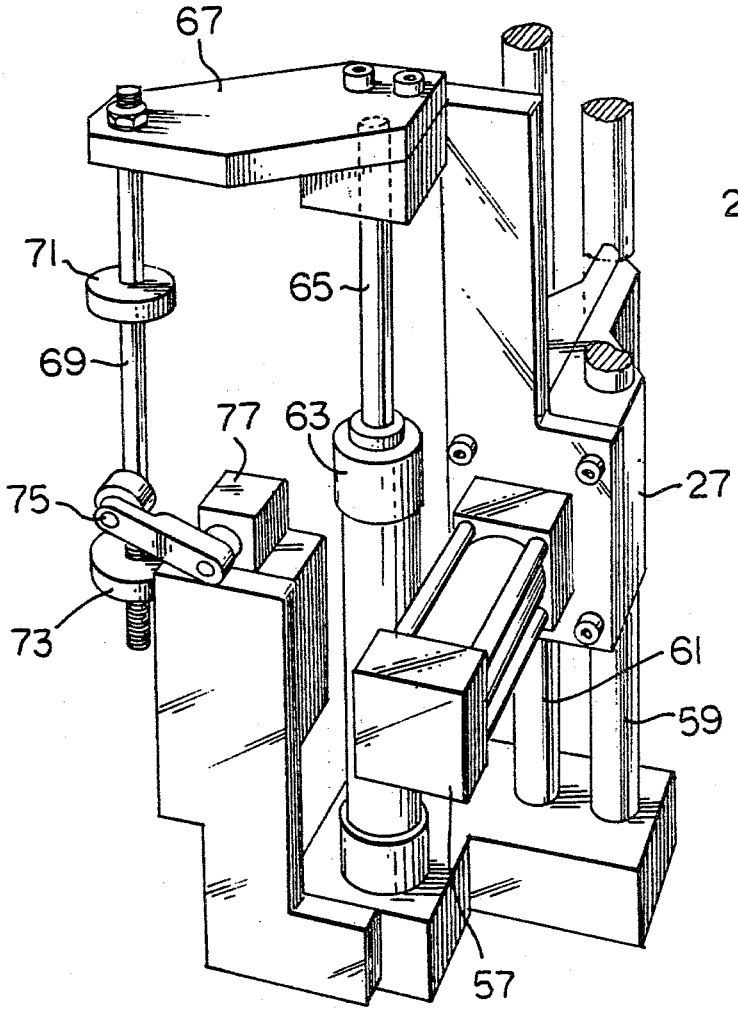
FIG. 4 is a perspective view of the portion of the machine of FIG. 1 which movably supports a tool.

A surface treating tool such as the bonded abrasive honing stone 25 is supported by a tool holder 27 and passes between a pair of adjacent cylindrical rollers to engage the outer peripheral surface of the workpiece. As best seen in FIG. 4, this tool is forced against the piston ring faces by an air cylinder 57. The air cylinder in turn is slidably supported on a pair of guide rods 59 and 61 and may be reciprocated in directions generally parallel to the roller 15 axes by actuation of air cylinder 63. As air is supplied to the cylinder 63, piston rod 65 moves upwardly raising the tool 25, tool holder 27 and air cylinder 57. A bracket arrangement 67 supports a threaded rod 69 having adjustable position indicators 71 and 73 threadably received thereon. When the rod 69 moves upwardly sufficiently far, the indicator 73 engages arm 75 moving the arm upwardly to change the state of, for example, a microswitch 77 which is connected to reverse the supply of air to cylinder 63 causing the entire reciprocable structure to begin a downward movement. Similarly when indicator 71 engages arm 75 the status of microswitch 77 is again changed and the entire reciprocable structure begins another upward motion. While a microswitch 77 may be employed other valve structures where movement of a control lever or arm 75 effects a change in the routing of an actuating fluid such as air to the cylinder 63 may be employed to effect the reciprocating motion of the tool.

There are conveniently three substantially identical structures 79, 81 and 83 for movably supporting tools angularly displaced about the workpiece and each supporting a tool which passes between adjacent pairs of rollers. No two tools of course occupy the space between the same pair of rollers. Since the several microswitches or valves 77 are essentially independent of one another and, since the position indicators (threaded nuts) 71 and 73 may be placed almost anywhere along the threaded rod 69, the reciprocating motions of the several tools are independent of one another and this asynchronous operation tends to minimize the axial forces exerted on the stack of rings by the tools. Such asynchronous operation aids the function of rollers such as 53 and 55 in maintaining adjacent rings in the stack in close proximity to one another. Associated with each tool support is a corresponding conduit such as 85 which functions to supply a fluid to the region of engagement between the workpiece and tool for rinsing loose abrasive material and abraded ring material from that region. The rinsing material may be kerosene and may be recirculated as desired.

Figure 5:
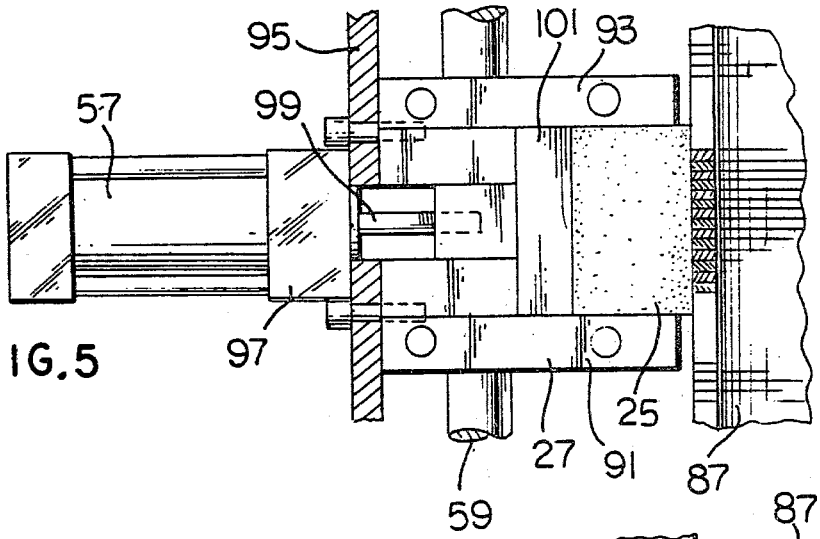
FIG. 5 is a side elevation partially in section illustrating the tool holder and tool engaging a plurality of piston rings.
Figure 6:
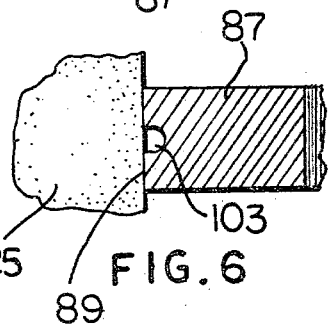
FIG. 6 is an enlarged view in section of a portion of FIG. 5 illustrating the engagement between the tool and workpiece surface.

FIGS. 5 and 6 illustrate in greater detail the manner in which the tool is supported and the engagement between the tool and workpiece surface. An exemplary intermediate piston ring 87 has its ring face or outer peripheral surface 39 engaged with the tool 25 which, in the preferred embodiment, is a honing stone of aluminum oxide in a relatively soft binder material. This bonded abrasive is slidably supported in guides such as 91 and 93 so that the bonded abrasive may move to the left or right as viewed in FIG. 5. The guides 91 and 93 are fixed to vertical plate 95 which in turn has affixed thereto the body 97 of air cylinder 57. Piston 99 is movable when energized to force by way of plate 101 the bonded abrasive 25 toward or away from the workpiece. In a preferred embodiment a 60 to 80 pound per square inch force was applied between the abrasive hone 25 and the piston ring surfaces.

The exemplary piston ring 87 may be any type piston ring, however, as illustrated in FIGS. 6 and 7, the ring is a so-called compression ring having a groove 103 cut about its entire outer periphery. Such a groove tends to fill with carbon when the ring is in use and the carbon provides a lubricating action to minimize piston ring wear. In honing the face of ring 87 the process is typically stopped short of obliterating this groove 103. Oil seal rings could, of course, also be processed according to the present techniques and such oil seal rings typically have radially extending apertures from the ring face communicating with the annular interior surface 102 of the ring for lubricating purposes, however, a compression ring has been taken as exemplary.

Such an exemplary compression ring is illustrated in FIG. 7 which depicts in perspective the typical compression ring. The workpiece surface or ring face 89 again contains the groove 103 and the flat top surface 105 corresponds to the surface of top ring 51 in FIG. 1 which would be engaged by the rollers 53 and 55. A similar flat bottom surface is not visible in FIG. 7 but would correspond to the surface of bottom ring 45 in FIG. 1 which would engage rollers 47 and 49.

Figure 8:
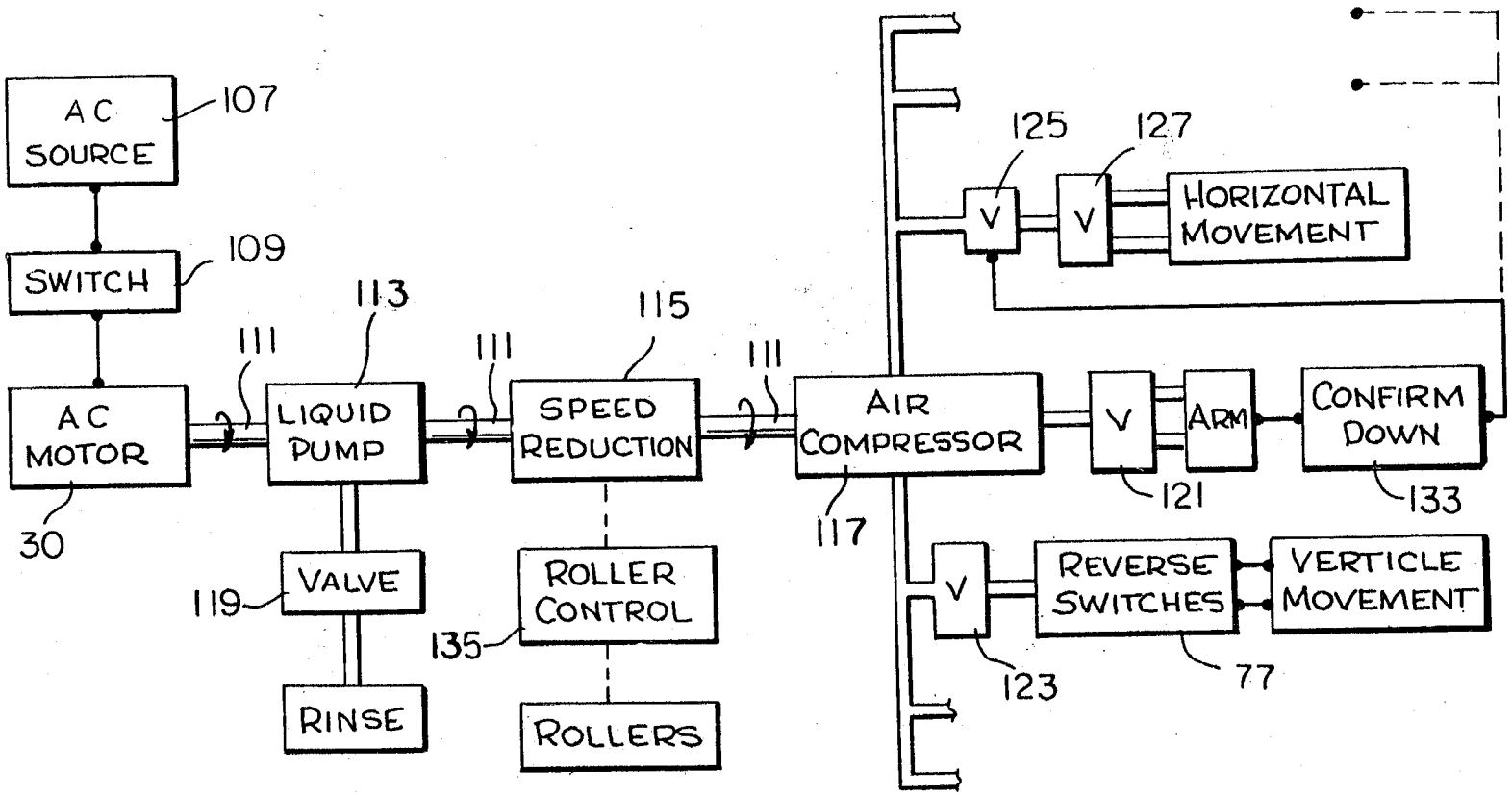
FIG. 8 is a generalized schematic diagram of the control arrangement for the machine of FIG. 1.

The control arrangement for the machine illustrated may be implemented in numerous ways and FIG. 8 illustrates in general terms one control arrangement. An alternating current source 107 is selectively coupled by master switch 109 to an alternating current motor 30. The rotor of motor 30 drives by way of one or more shafts 111 a liquid pump 113, a speed reducing arrangement 115 and an air compressor 117. Liquid pump 113 when enabled by the opening of valve 119 supplies the rinsing fluid by way of, for example, conduit 85 of FIG. 1 to the region of engagement between the tool and workpiece. Speed reduction arrangement 115 corresponds broadly to the gear reducing box 21, drive gear 19 and driven gear 17 along with the pulley and V-belt coupling 23 illustrated in FIG. 1 and functions to drive the rollers as previously described. The air compressor 117 may be omitted on machines to be used in a typical factory where a source of compressed air is independently available; however, for completeness, such an air compressor supplies air to a valve 121 which under operator control functions to raise or lower arm 43 for loading or unloading piston rings in the machine. Compressor 117 also supplies air by way of operator actuated valve 123 to the reversing switch 77 to reciprocate the tools by means of air cylinders 63 in the direction parallel to the roller axes. Multiple tool support systems would be connected in a similar manner as illustrated by the dotted lines and may be independently operator controllable. Air compressor 117 still further supplies air to a valve 125 which is enabled to pass that air only when arm 43 is in proper position to retain the rings within the machine for processing. If the arm is in proper position the operator may actuate valve 127 to move the tool against the workpiece for finishing that workpiece. Similar controls would be provided for the other tools. While only one interlock or safety feature has been illustrated in the form of valve 125 other controls could be added to prevent, for example, actuation of the rollers unless the arm is in its proper operating position and the tool engaged with the piston rings.

Figure 9:
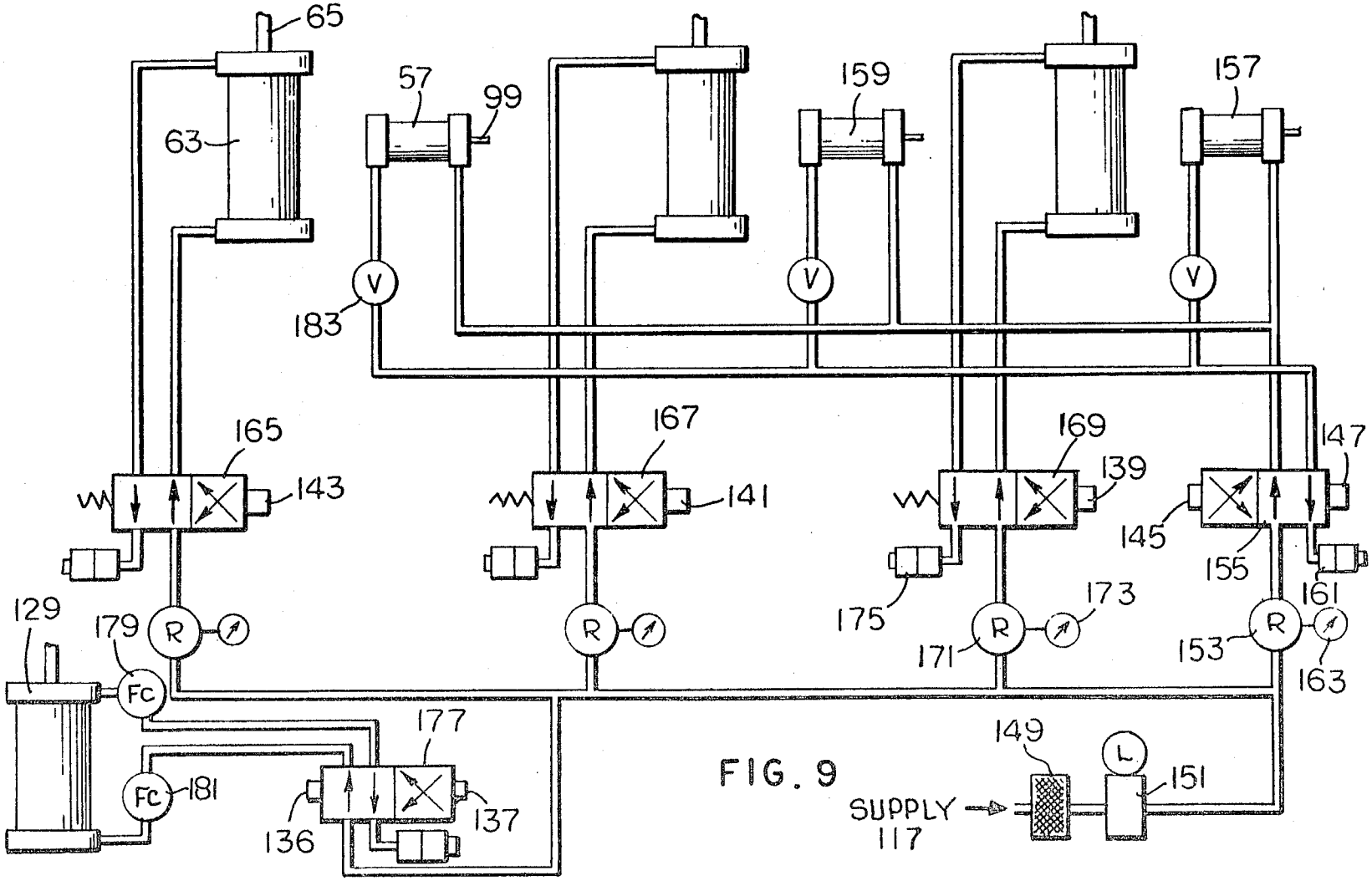
FIG. 9 is a pneumatic, schematic illustration in detail of one approach for implementing the present invention.

While FIG. 8 illustrates the concepts of a control arrangement employable in the present invention, FIGS. 9 through 13 illustrate in detail a preferred exemplary embodiment with reference numbers carried over onto these schematic diagrams from previous drawing illustrations where possible. In FIG. 9 a number of solenoid operated valves have their control solenoids identified by reference numerals 136, 137, 139, 141, 145 and 147, and in FIG. 11 the corresponding coils of those solenoids are identified by corresponding primed reference numerals.

FIG. 9 is a pneumatic, schematic diagram with air supply 117 passing through an air filter 149 and lubricator 151 to, by way of pressure regulator 153 and valve 155, energize and deenergize the several air cylinders 157, 159 and 57, which force the respective tool or stones into engagement with the ring faces. Air is exhausted from the opposite side of each of these last-mentioned cylinders by way of a muffler 161. A pressure gauge, such as 163, may also be provided.

Reciprocation of the several stones is effected by air cylinders, such as 63, each of which is supplied by way of its own individual valve 165, 167 and 169. Each of these three valves has an input air pressure regulator, such as 171, and corresponding pressure gauge 173, and on the outlet side of the valve, a muffler 175. A still further valve 177 controls the air supplied to air cylinder 129 for raising and lowering arm 43. Flow control restrictors 179 and 181, as well as ball check valves, such as 183, may be provided as desired.

FIGS. 10, 11, 12 and 13 illustrate a complete electrical control system for an exemplary embodiment wherein control relays and their respective contacts are illustrated in a manner conventional in this art. Typically the control relay will be indicated by a circle containing a reference number and descriptive letters such as CR and normally open contacts associated with that relay bear the same legend and are depicted by a pair of parallel lines. Normally closed contacts associated with that relay bear the same legend and parallel lines and additionally have a transverse line indicating the normally closed status of that contact.

Figure 10:
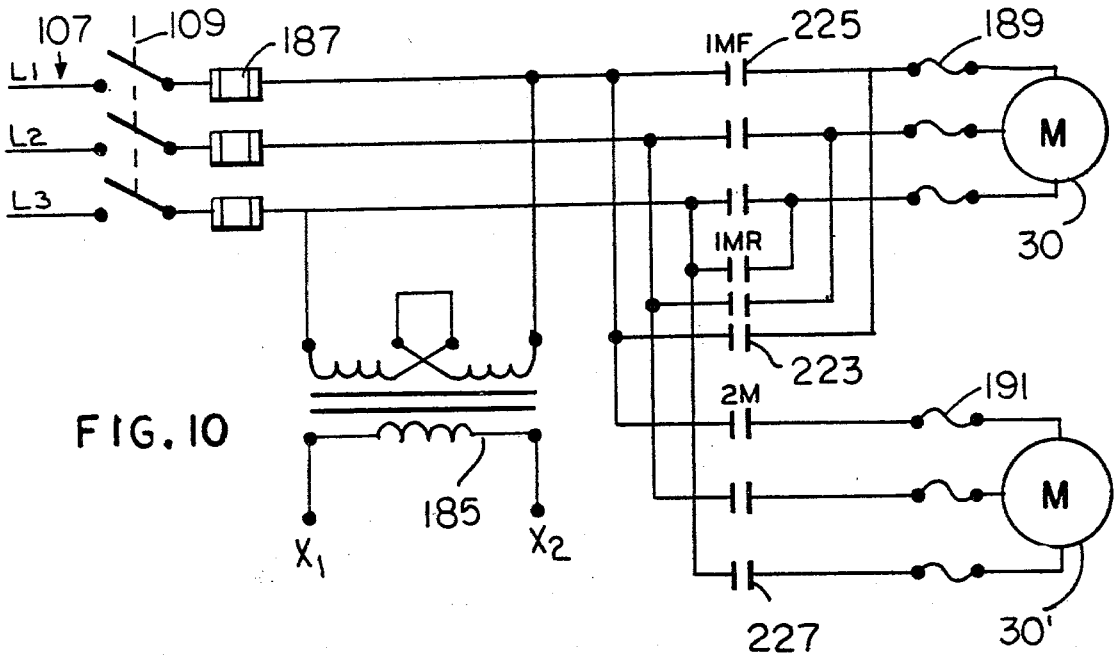
FIG. 10 is a schematic diagram of the power source and prime movers for the pneumatic and mechanical portions of the system.
Figure 11:
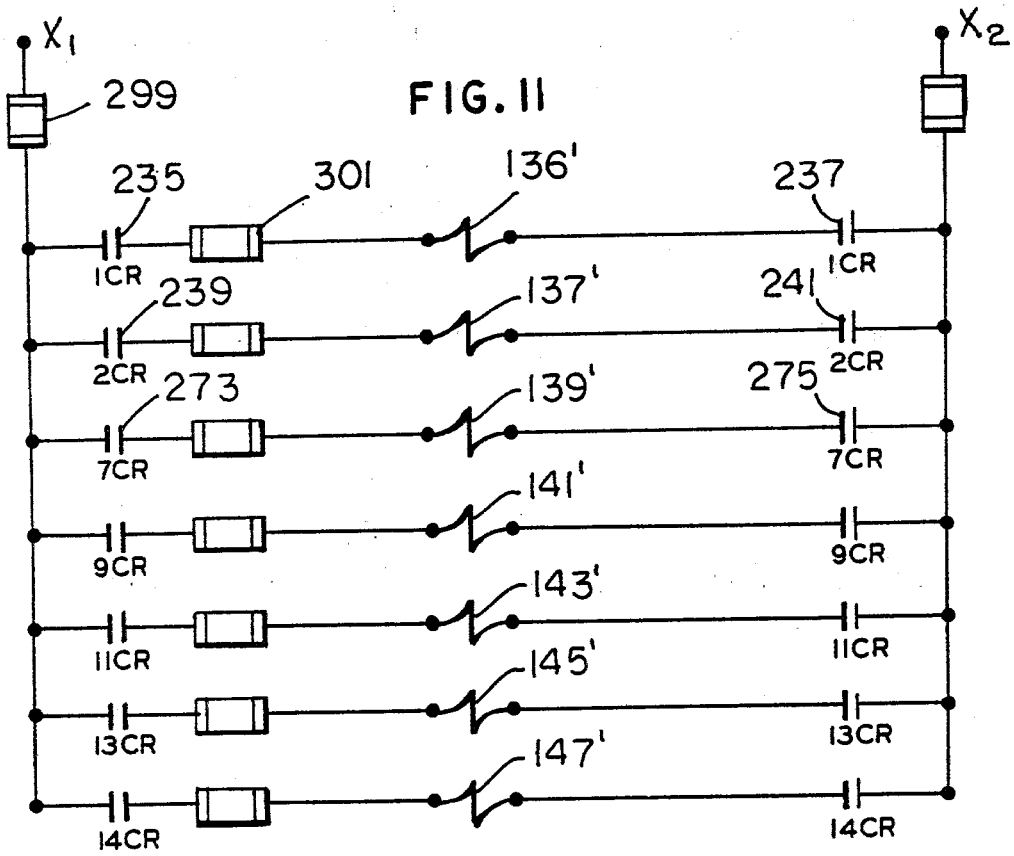
FIG. 11 is a schematic diagram illustrating the control circuitry for the pneumatic control solenoids and comprises the interface between the electrical and pneumatic portions of the system.
Figure 12:
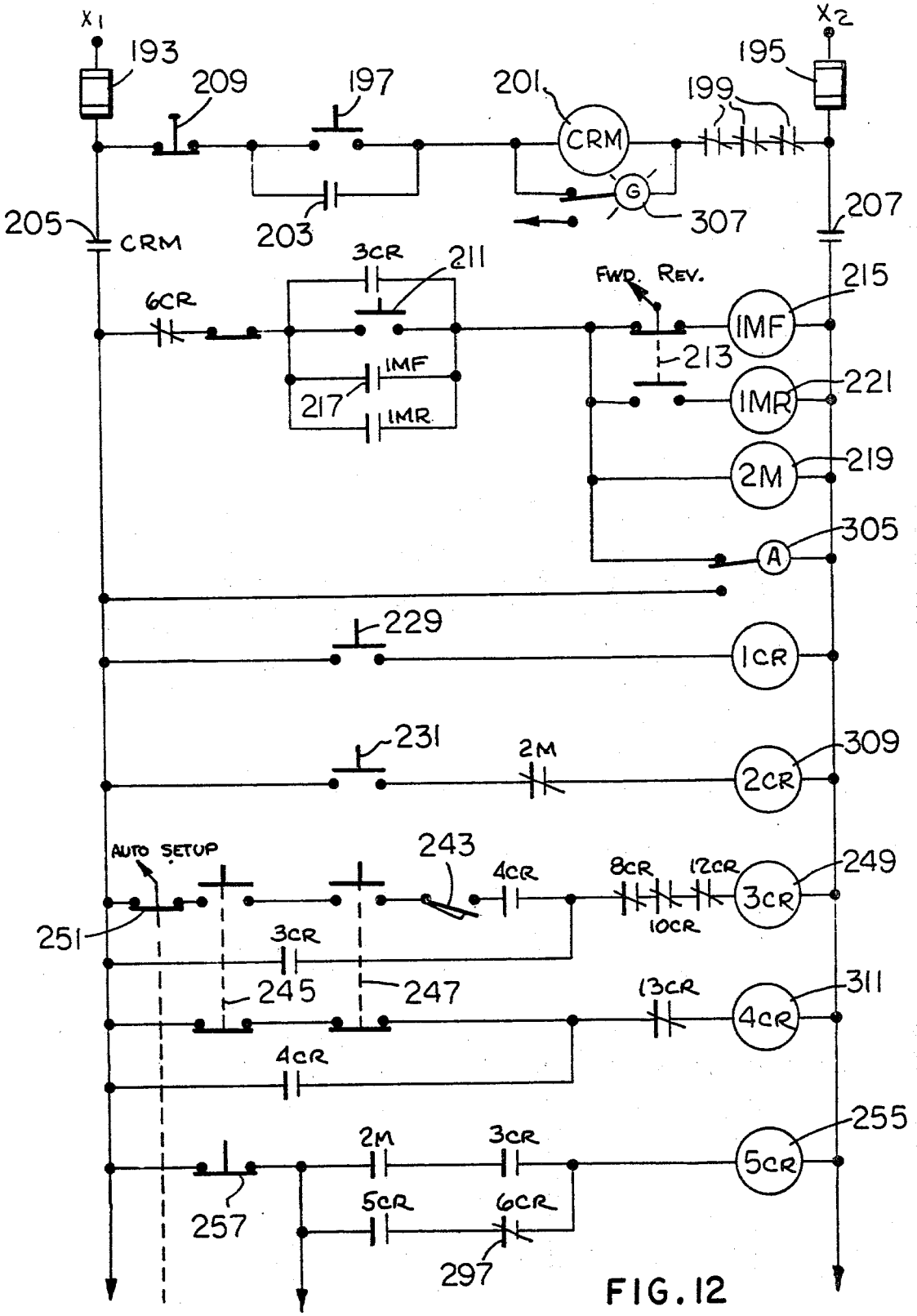
FIGS. 12 and 13, when joined with FIG. 12 above
Figure 13:
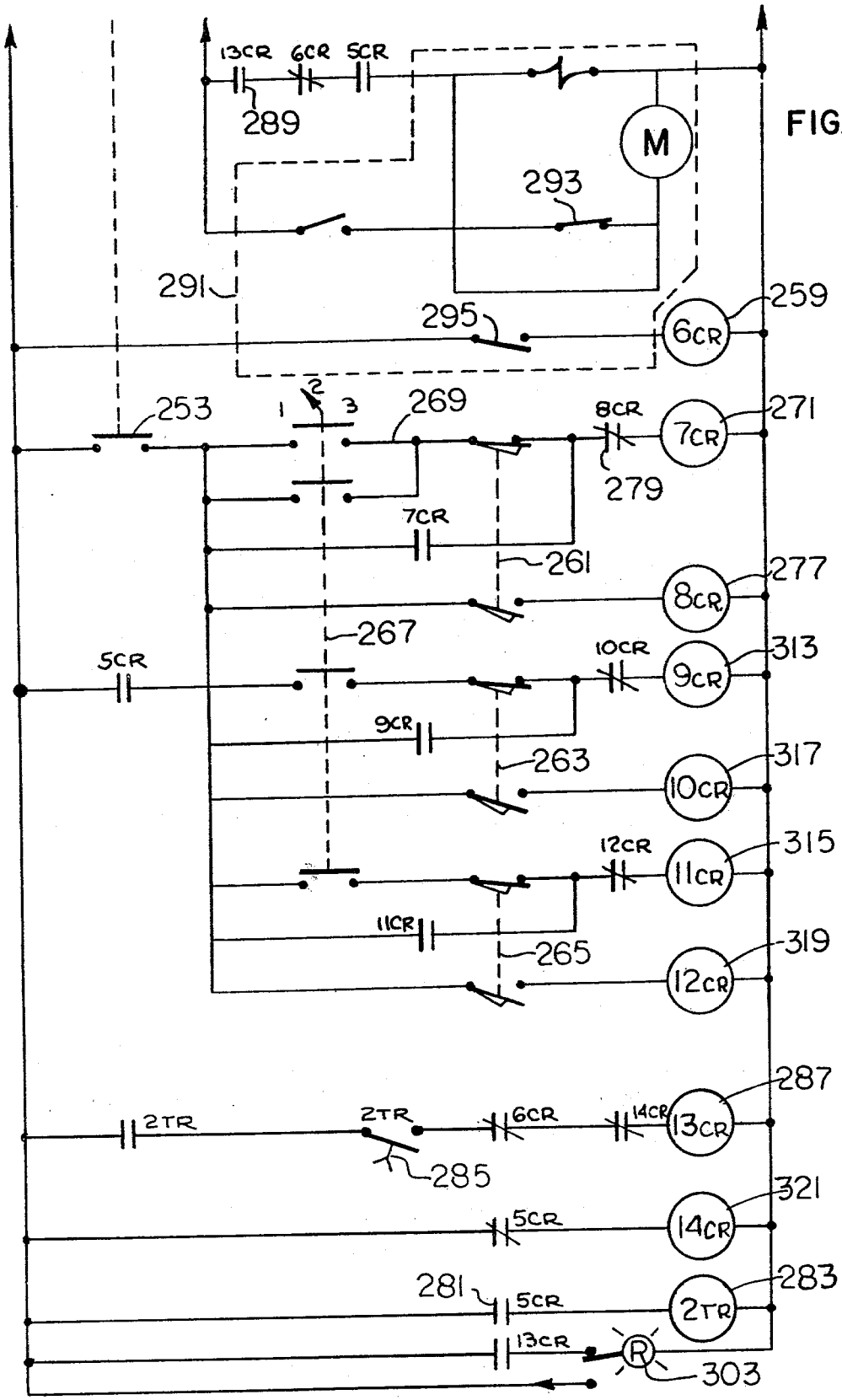

In FIG. 10 a source 107 of three-phase alternating current is applied to the system by the closure of main switch 109. One phase by way of transformer 185 supplies energy to the remaining electrical circuitry and the three-phase energy is supplied by way of fuses, such as 187, 189 and 191, to the spindle drive motor 30 and pump motor 30', respectively.

The secondary winding of transformer 185 supplies energy to terminals X1 and X2 by way of further fuses 193 and 195 and the machine is energized by depressing momentarily the machine "on" switch 197, which by way of normally closed overload contacts 199 energizes the control relay 201 to latch its contact 203 as well as closing contacts 205 and 207 to supply energy to the remaining portions of the control circuitry. Control relay 201 may be deenergized by momentarily depressing the normally closed master stop switch 209. Motors 30 and 30' may now be energized by depressing momentarily the normally open switch 211, which by way of the ganged forward reverse switch 213 in its forward position energizes control relay 215, latching that control relay on due to the closure of contacts 217 and additionally energizing the pump motor, due to the simultaneous energization of control relay 219. It should be noted if switch 213 is in the reverse position opposite that illustrated, control relay 221, rather than 215, would be energized and contacts such as 223, rather than 225 in FIG. 10, would close, causing the motor 30 to rotate in the opposite direction. Pump motor 30' is of course energized due to the closure of the three contacts 227.

The ring trap (clamp or arm 43) is raised and lowered by closing either switch 229 or 231 to energize the corresponding control relays. Contacts for these respective relays are illustrated at 235 and 237 or in the case of raising the arm 239 and 241 in FIG. 11.

If the arm 43 is in its proper down position to hold the rings in place, limit switch 243 is closed and a honing operation may be instigated by the simultaneous depression of ganged switches 245 and 247. These switches are physically separated on the machine requiring left-hand, right hand depression by the operator for safety reasons. Depression of switches 245 and 247 energizes control relay 249, closing its associated contacts and initiating the honing cycle.

With reciprocation control switch contacts 251 closed for automatic reciprocation of the several honing stones, the corresponding ganged contacts 253 are open and the reciprocation controls will only be energized in the event that control relay 255 is energized and this control relay will be energized so long as the cycle stop switch is not depressed to open contacts 257 and so long as control relays 249 and 219 are energized or so long as control relay 255 itself is energized and control relay 259 is not energized. Under these circumstances the exemplary three honing stones will reciprocate back and forth. Associated with each stone are a pair of ganged limit switches 261, 263 and 265, each of which has only one set of contacts closed at any time, and the particular contacts which are closed changes each time a stone reaches its limit of travel in either direction. Ganged switch 267 is a multiple position selector switch allowing any one stone to be operated or reciprocated or allowing all three stones to reciprocate depending upon the position. If switch 267 is closed to supply current for one of the stones on line 269, so long as switch 261 is closed in the position illustrated, control relay 271 will be enabled, closing contacts 273 and 275 to advance the honing stone in a specified direction. When the stone reaches an end limit of its travel, switch 261 changes state enabling control relay 277, opening contacts 279, and disabling control relay 271. Remembering that the corresponding valve 169 of FIG. 9 is spring loaded to change state when its solenoid 139 is deenergized, the direction of stone reciprocation will reverse as desired. The other control relay arrangements for other honing stones operate in a similar manner.

Energization of control relay 255 closes contacts 281 to start a short interval timing relay 283, which after its specified delay, closes switch 285, energizing control relay 287 to advance the stones toward the workpiece surface and also to close contacts 239, energizing a commercially available motor driven timer 291. At the beginning of its timing cycle, timer 291 has contacts 293 closed and contacts 295 open. At the end of the cycle of timer 291, contacts 293 open, deenergizing the timer and contacts 295 close to energize control relay 259. Energization of control relay 259 interrupts the latching circuit for control relay 255, by opening contact 297, and when relay 255 is deenergized, the cycle stops.

Numerous additional fuses, such as 299 and 301, may be provided as desired, and numerous indicators, such as 303, for indicating that the honing stones are in place against the workpiece, and 305, which indicates the motors are running, as well as 307, which indicates that the machine is "on" may be provided, as desired. It should now be clearly understood, for example, that control relay 309 provides the function of raising the ring trap or arm, while control relay 311 functions as an anti-repeat relay, which is energized when the start buttons are depressed. Control relays 313 and 315 function in a manner analagous to control relay 371, while their corresponding control relays 317 and 319 are analagous to control relay 277 for the other honing stones. Similarly, control relay 321 may be actuated to retract the stones from the working surface when the cycle stop control relay 255 is deenergized.

Figure 14A:
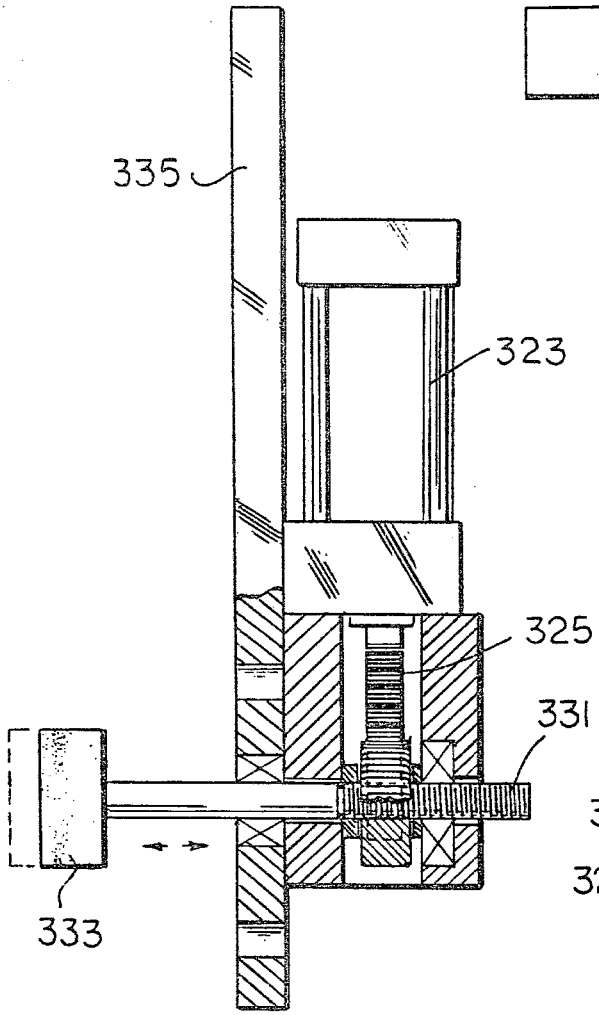
Figure 14B:
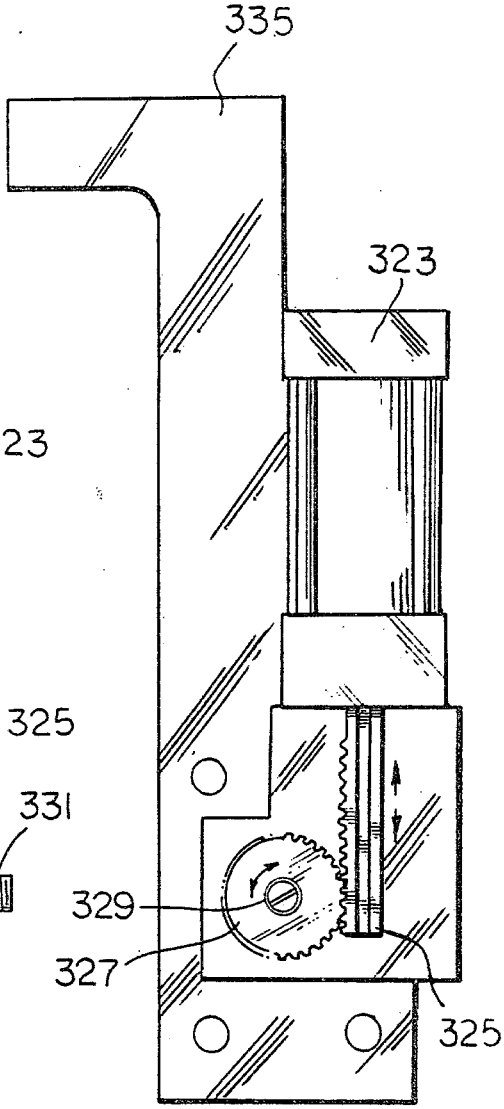

Turning now to FIGS. 14*a* and 14*b*, which illustrate a variation on the structure of FIG. 4 for movably supporting the tool, an air cylinder 323 reciprocably drives a toothed rack 325, which in turn engages gear 327 to rotate that gear as the air cylinder is acutated. The interior of gear 327 is threaded at 329, as is shaft 331, and therefore rotation of gear 327 forces shaft 331 to the left or right as viewed in FIG. 14*a*, thereby retracting or advancing stone 333 relative to the workpiece. The bracket arrangement 333 may be supported for vertical reciprocation as in the previous embodiment and the embodiment of FIGS. 14*a* and 14*b* is particularly desirable because close control over the pressure exerted between stone 333 and the workpiece is possible.

To finish a piston ring face the process may now be rather simply outlined. One or more rings are compressed radially inward in the direction of the arrows illustrated in FIG. 7 into a generally circular configuration and placed inside the set of rollers as illustrated in FIG. 1, valve 121 is then actuated to move arm 43 downwardly by way of air cylinder 129. This air cylinder like the others is a reversible type. An alignment pin 131 may fit within an aligning hole to insure that the arm is properly positioned and a microswitch may be actuated by that alignment pin to provide the "arm down" confirmation 133 of FIG. 8. A tool such as the honing stone 25 is then placed against the ring face by actuating valve 127 and thereafter the rings caused to rotate by rotation of the rollers when the roller control 135 is engaged. Preferably prior to or simultaneous with actuation of the roller control 135, valve 119 would be opened to supply the rinsing liquid to the area of tool engagement with the ring face. The tool may remain in a fixed vertical position or valve 123 may be actuated to allow the reciprocating vertical tool motion. As material is removed from the ring face the ring will gradually expand radially outward and maintain a constant ring outer diameter as determined by the positions of the rollers 15. In this manner the ring is totally located by its outside diameter and processed about that outside diameter allowing the ring to change shape and configuration during the time that it is being processed and to become as close to perfectly round as possible.

FIG. 15 illustrates the improvement in eccentricity achieved by the present invention as compared to the aforementioned prior art piston ring honing procedures. Solid curve 337 illustrates the measured pressures exerted by a piston ring at numerous points about its periphery when compressed to its desired diameter. Curve 337 is a curve measured on a prior art produced piston ring.Curve 339 similarly illustrates the pressure at the same points for a ring produced in accordance with the present invention. It will be noted that the prior art ring had variations of from nearly 0 to 3 lbs. pressure at the various points around its periphery whereas a ring manufactured in accordance with the teachings of the present invention varied generally from one to two pounds pressure. Pressure points 1 and 17 of course correspond to the two edges of the rings immediate adjacent to the ring gap.

From the foregoing it is now apparent that a novel workpiece surface processing apparatus and method has been described meeting the objects and advantages outlined hereinbefore as well as others. Numerous modifications will suggest themselves to those of ordinary skill in the art and may be made without departing from the spirit or scope of the invention as set out in the claims which follow.

What is claimed is:

1. The method of finishing a plurality of piston ring faces comprising the steps of, supporting a plurality of stacked piston rings so that they have a common center axis by engaging their outer surfaces with a plurality of rollers mounted parallel to the center axis and equally spaced about the outer surfaces of said piston rings, driving at least one of said plurality of rollers so as to rotate said piston rings, engaging the outer surfaces of said piston rings with a first tool between two of said plurality of rollers and moving said first tool parallel to said center axis to hone the outer surfaces of said rings, and engaging the outer surfaces of said piston rings with a second tool on the sides opposite to the sides engaged by said first tool and moving said second tool parallel to said center axis to hone the outer surfaces of said rings.

2. The method of claim 1 wherein the movements of said first and second tools are independent of each other.

* * * * *